United States Patent [19]

Poulton

[11] Patent Number: 4,998,991

[45] Date of Patent: Mar. 12, 1991

[54] MATERIALS HANDLING EQUIPMENT

[75] Inventor: Barrie A. Poulton, Cheltenham, England

[73] Assignee: Flomat Limited, Derbyshire, England

[21] Appl. No.: 444,533

[22] Filed: Dec. 1, 1989

[30] Foreign Application Priority Data

Dec. 9, 1988 [GB] United Kingdom ..... 8828774.3

[51] Int. Cl.[5] ..... B67D 3/00

[52] U.S. Cl. ..... 222/181; 414/403; 222/386.5; 222/95; 248/579

[58] Field of Search ..... 414/403, 404, 415, 787; 222/94, 95, 97, 103, 105, 180, 181, 386, 386.5; 248/579, 580; 383/111

[56] References Cited

U.S. PATENT DOCUMENTS

| | | | |
|---|---|---|---|
| 2,722,171 | 11/1955 | Deringer | 222/386.5 X |
| 3,228,558 | 1/1966 | Doyle et al. | 222/386.5 X |
| 3,424,422 | 1/1969 | Klangos | 248/579 X |
| 3,961,655 | 6/1976 | Nattrass et al. | 222/181 X |
| 4,449,646 | 5/1984 | Bonerb et al. | 222/95 |
| 4,527,716 | 7/1985 | Haas et al. | 222/181 X |

FOREIGN PATENT DOCUMENTS

| | | | |
|---|---|---|---|
| 1355559 | 11/1987 | U.S.S.R. | 222/386.5 |

*Primary Examiner*—Frank E. Werner

[57] ABSTRACT

This invention relates to equipment assisting the discharge of particulate materials from intermediate bulk containers of the kind comprising an outer bag having an inner lining comprising frame members to which the upper end of the outer bag of an intermediate bulk container can be anchored, cord devices extendable against the action of resilient devices and adapted to be connected with the upper end of an inner liner to the outer bag, pulley devices for guiding the cord devices to the position of connection with the liner, a pivoted arm and devices for attaching the free end of the cord devices to the arm at a position spaced from its pivot, the arrangement being such that the arm can be swung to carry the free end of the cord means to a position for connection with the liner.

11 Claims, 2 Drawing Sheets

MATERIALS HANDLING EQUIPMENT

TECHNICAL FIELD

This invention concerns equipment for handling powdered, granulated or other particulate solid materials and more especially equipment of the kind (hereinafter termed "of the kind referred to") used to assist the discharge of such materials from intermediate bulk containers adapted to be used repeatedly and popularly referred to within the industry as "multi-trip big bags".

BACKGROUND PRIOR ART

Intermediate bulk containers in the form of large bags usually having an inner liner are becoming increasingly commonly used for the storage and dispensing of bulk particulate solids. Those adapted for repeated use have a tubular spout on their underside which must be untied and released to permit discharge.

The inner liner serves many purposes. The outer bag can be used many times without risk of contamination by inserting a replacement liner each time the bag is used. The inner liner prevents egress of very fine powders through the weave or seams of the outer bag. The liner prevents ingress of water to the product during transport of the bag and gives some measure of protection to the product if the outer bag should become damaged.

A major disadvantage of using an internal liner is the problem that occurs during the discharge of material from the bag. The common practice of discharging a bag is simply to hang the bag by four loops, open the spout on the outer bag, and unfasten the goose-neck of the internal liner, thus allowing the product to discharge freely or through a discharging machine. As the bag discharges the level of material eventually drops to a point where there is insufficient pressure to hold the liner against the walls of the bag, with the result that the liner slips and blocks the discharge outlet, or alternatively the liner drops through the spout and runs the risk of becoming entangled with the handling equipment below.

Various attempts to overcome this disadvantage by tying the upper end of the liner to support means before discharge have not proved wholly satisfactory since the liner can still collapse and interfere to some extent with discharge.

More recently, and as described in our co-pending U.S. application Ser. No. 183,642, filed Apr. 19, 1988, now U.S. Pat. No. 4,883,201, issued Nov. 28, 1989, cord means extendable against resilient means and adapted to be connected with the upper end of an inner liner is provided to draw the liner upwardly from the outer bag as emptying proceeds.

Although this solution is effective, problems have arisen, in that the cord must be drawn against the action of the resilient means for connection to the liner, and such connection must be completed without releasing the cord which would otherwise retract. All of this requires some physical prowess and great caution must be exercised to prevent the fingers being trapped by the tensioned cord with risk of injury.

It is an object of the present invention to provide means for overcoming the problems aforesaid.

SUMMARY OF THE INVENTION

According to the present invention there is provided equipment of the kind referred to comprising frame members to which the upper end of the outer bag of an intermediate bulk carrier can be anchored, cord means extendable against the action of resilient means and adapted to be connected with the upper end of an inner liner to the outer bag, pulley means for guiding the cord means to the position of connection with the liner, a pivoted arm and means for attaching the free end of the cord means to the arm at a position spaced from its pivot, the arrangement being such that the arm can be swung to carry the free end of the cord means to a position for connection with the liner.

The cord means may be extendable from a reel.

The pulley means may comprise two spaced drums rotatable about horizontal axes.

The arm may be pivoted at a position midway between the spaced drums.

One of the drums and the means from which the cord is extendable may be connected to said pivoted arm.

The means for attaching the free end of the cord means to the arm may comprise a loop on the free end of the cord engageable with a pin on the arm.

The pin may have a free end which is uppermost before the arm is swung to carry the cord to the connection position when it is directed downwardly.

The invention will be further apparent from the following description, with reference to the several figures of the accompanying drawings, which show, by way of example only, two forms of equipment of the kind referred to embodying same.

DETAILED DESCRIPTION

Figure 1:
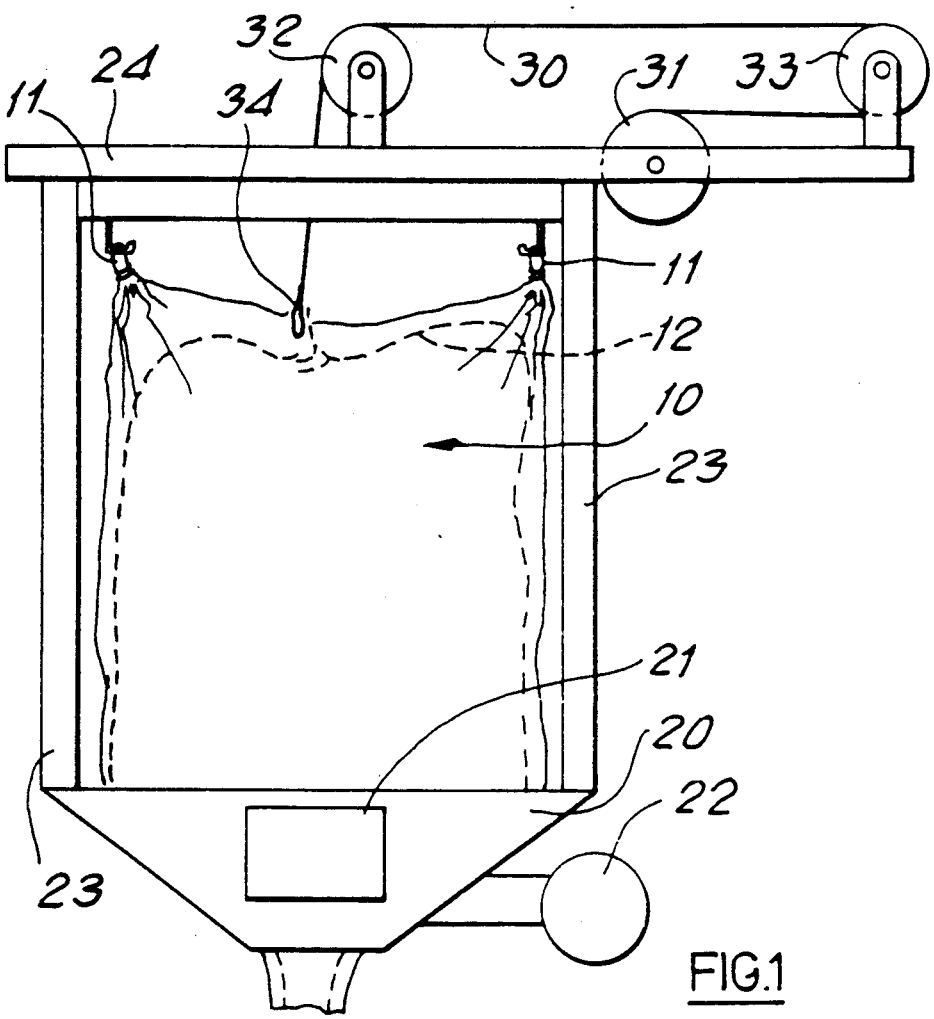
FIG. 1 shows a side elevation of a first form of the equipment.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the broad aspect of the invention to embodiment illustrated.

Referring now to the drawings, it will be seen that the discharge equipment comprises a shallow hopper 20 of square shape adapted to receive the lower end of the bag 10 and having a door 21 through which access may be had by an operator to untie and release the discharge spout of the bag 10 and also equipped with motor driven eccentric weight vibration means 22.

Posts 23 extend upwardly from the corners of the hopper 20 and form support means for a rigging frame 24.

When an intermediate bulk carrier is to be emptied, loops 11 on the upper end of the bag 10 are connected with the frame 24. This operation is known as 'rigging'. The frame and bag may be moved by fork-lift truck, whose forks can engage slot 25 (FIG. 2) on frame 24 to position the bag 10 on the hopper 20 and the frame 24 on the support means.

Figure 2:
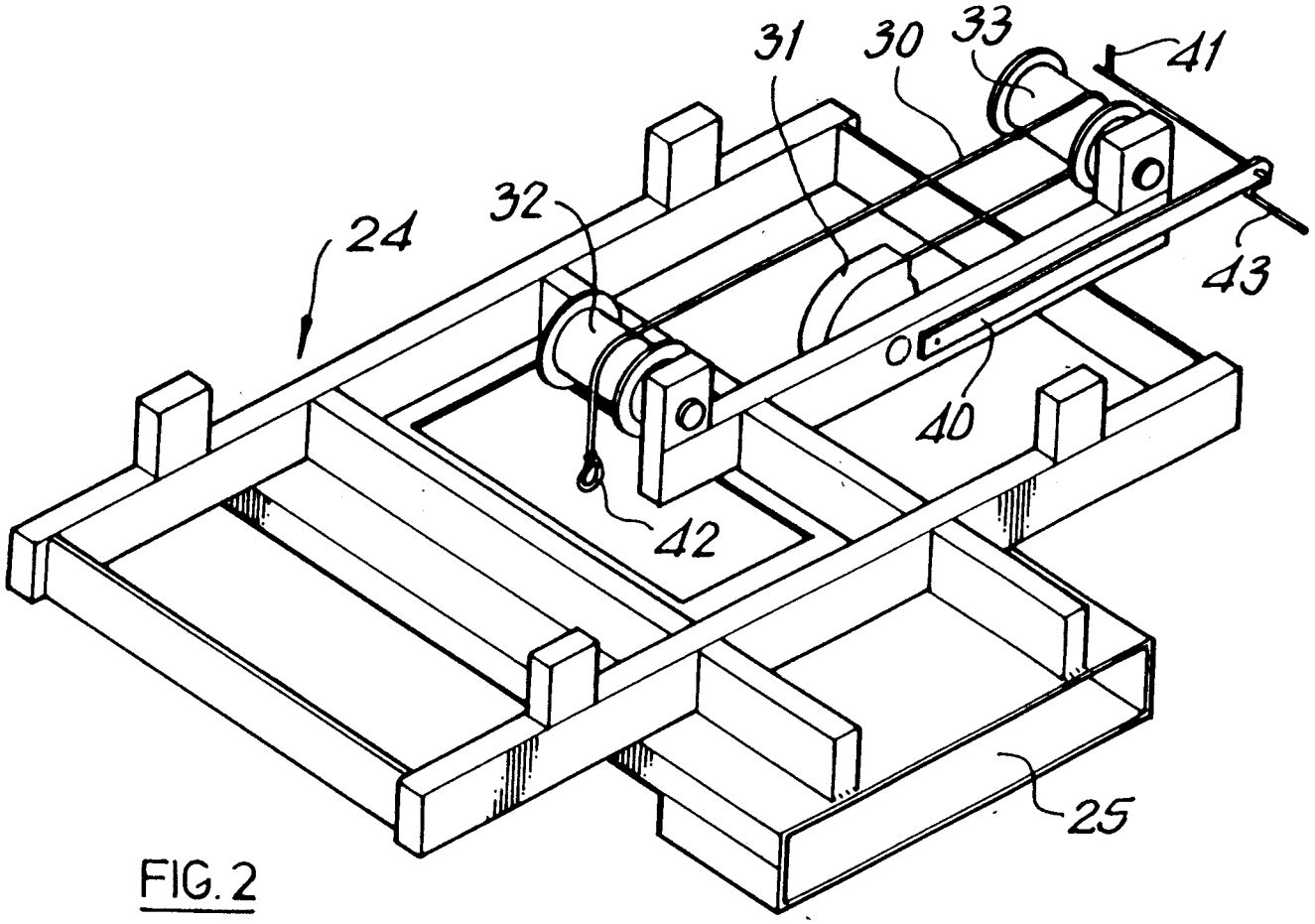
FIG. 2 shows a perspective view from above of the rigging frame of the equipment of FIG. 1.

A cord 30 may be deployed outwardly against resilient return means from a reel 31. The cord passes over a pair of spaced rotationally mounted drums 32 and 33 and may be led into the interior of the outer bag for connection with the top of the inner liner 12 by means of a slip knot 34. The axes of the drums 32 and 33 are horizontal and lie in a common horizontal plane, as shown in FIG. 2.

In accordance with the invention an arm 40 is provided and connected with the frame 24 at a position midway between the axes of the drums 32 and 33. The free end of the arm 40 mounts a vertical pin 41 whose upper end is free (when the arm is in the position shown in FIG. 2) to be engaged by a loop 42 on the end of cord 30 to attach the cord to the arm.

The arm may be swung upwardly by handle means 43 through 180° to carry the cord around the drums 32 and 33 and position the free end of the cord over the top of bag 10 for connection with the upper end of the inner liner 12. During this operation, tension in the cord 30 maintains the attachment even though, after the arm has been swung; the free end of the pin 41 is directed downwardly.

After the connection has been made, the arm 40 is swung back to its original position, the loop 42 which is now amended by the weight of material in the bag sliding from engagement with the pin 41.

In use as the inner liner empties, the slack in same is taken up and the upper end of the inner liner is drawn outwardly from the outer bag over the drums 32 and 33 and towards the reel 31.

Typically, the arrangement will exert a force of 11 kgms and enable up to 1 m or so of liner to be withdrawn from the bag.

Figure 3:
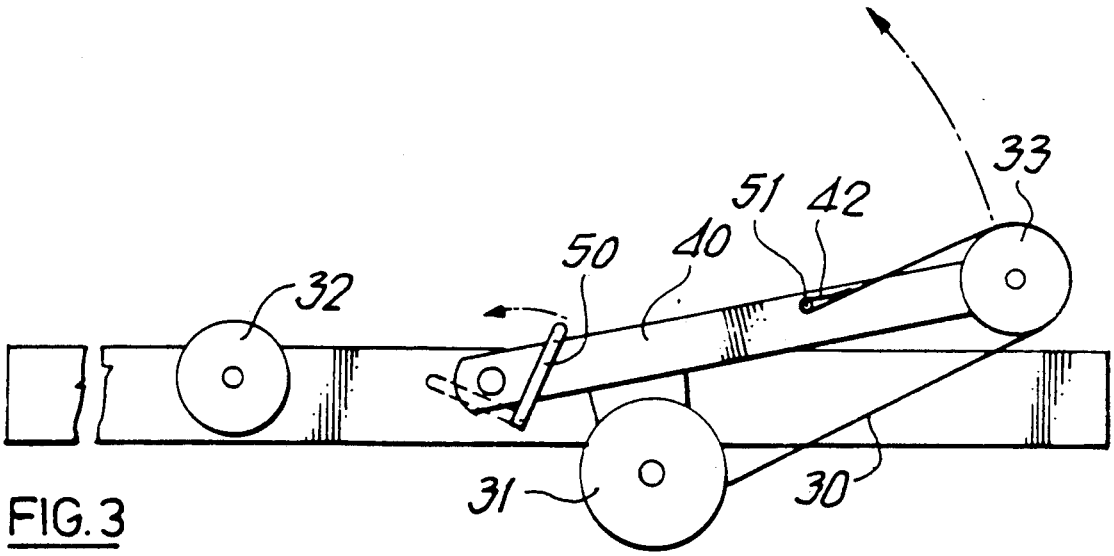
FIG. 3 shows a side elevation of modified mechanism in a second form of the equipment.

Referring now to FIG. 3, wherein like parts are indicated by like reference numerals, it will be seen that the reel 31 and drum 33 are themselves mounted on and carried by the pivoted arm 40. A pivoted stirrup means 50 is provided for locking the arm 40 in its normal in use position (as shown in FIG. 3). In this arrangement the loop 42 is secured to a peg 51 on arm 40 and the arm 40 is swung to carry the loop 42 for connection with the liner. After connection, the arm 40 is swung back and secured by the stirrup means 50. It will be understood that an initial length of cord is withdrawn from the reel 31 after connection with the inner liner rather than before as with the arrangement of FIGS. 1 and 2.

It will be appreciated that it is not intended to limit the invention to the above example only, many variations, such as might readily occur to one skilled in the art, being possible, without departing from the scope thereof as defined by the appended claims.

I claim:

1. Equipment for assisting the discharge of particulate materials from an intermediate bulk container of the kind comprising an outer bag with an upper, substantially closed end and a lower open end and having an inner liner with a closed upper end and a lower open end and comprising frame members to which the upper end of the outer bag of the intermediate bulk container can be anchored, cord means extendable against the action of resilient means and adapted to be connected through an opening in the upper end of said bag with the upper end of the inner liner to the outer bag, pulley means for guiding the cord means to the position of connection with the liner, a pivoted arm and means for attaching the free end of the cord means to the arm at a position spaced from its pivot, the arrangement being such that the arm can be swung to carry the free end of the cord means to a position to facilitate connection with the liner whereby material can be discharged from the open lower end of the liner.

2. Equipment according to claim 1, wherein the cord means is extendable from a reel.

3. Equipment according to claim 1, wherein the pulley means comprises two spaced drums rotatable about horizontal axes.

4. Equipment according to claim 3, wherein the arm is pivoted at a position midway between the spaced drums.

5. Equipment according to claim 3, wherein one of the drums and the means from which the cord is extendable are connected to and carried by said pivoted arm.

6. Equipment according to claim 1, wherein the means for attaching the free end of the cord means to the arm comprises a loop on the free end of the cord engageable with a pin on the arm.

7. Equipment according to claim 6, wherein the pin has a free end which is uppermost before the arm is swung to carry the cord to the connection position when it is directed downwardly.

8. Apparatus for assisting the discharge of particulate solid material from a bulk container in the form of an outer bag with an upper, substantially closed end and a lower open end and having an inner liner with a closed upper end and a lower open end and comprising frame means for supporting said outer bag at its said upper end, resilient return means on said frame means and including cord means having a free end adapted to be connected through an opening in the upper end of said bag with an upper end of said inner liner, the improvement of an arm means pivoted on said frame means and having a connection means for attaching said free end of said cord means at a position spaced from its pivot so that said arm means can be pivoted on said frame to carrying said free end of said cord means to a position to facilitate connection with said inner liner whereby material can be discharged from the open lower end of the liner.

9. Apparatus as defined in claim 8, further including drum means supported on said frame for guiding said cord means from said resilient means to said inner liner.

10. Apparatus as defined in claim 9, in which resilient return means includes a reel and said drum means includes first and second drums aligned with said reel on said frame to guide said cord means.

11. Apparatus as defined in claim 10, in which said reel and said first drum are mounted on said arm means for movement therewith.

* * * * *

UNITED STATES PATENT AND TRADEMARK OFFICE

CERTIFICATE OF CORRECTION

PATENT NO. : 4,998,991

DATED : March 12, 1991

INVENTOR(S) : Barrie A. Poulton

It is certified that error appears in the above-identified patent and that said Letters Patent is hereby corrected as shown below:

Column 3, Line 19, delete ";"

Claim 8, Column 4, Line 45, delete "carrying" and insert --carry--

Signed and Sealed this

Twenty-fifth Day of August, 1992

*Attest:*

DOUGLAS B. COMER

*Attesting Officer*

*Acting Commissioner of Patents and Trademarks*